US007742612B2

(12) United States Patent
Fröhlich et al.

(10) Patent No.: US 7,742,612 B2
(45) Date of Patent: Jun. 22, 2010

(54) METHOD FOR TRAINING AND OPERATING A HEARING AID

(75) Inventors: Matthias Fröhlich, Dechsendorf (DE); Thomas Hies, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 171 days.

(21) Appl. No.: 10/961,696

(22) Filed: Oct. 8, 2004

(65) Prior Publication Data

US 2005/0105750 A1 May 19, 2005

(30) Foreign Application Priority Data

Oct. 10, 2003 (DE) ..... 103 47 211

(51) Int. Cl.
*H04R 25/00* (2006.01)
*H04R 29/00* (2006.01)

(52) U.S. Cl. ..... 381/314; 381/60

(58) Field of Classification Search ..... 381/314, 381/60, 315, 313, 316, 317
See application file for complete search history.

(56) References Cited

U.S. PATENT DOCUMENTS

| | | | | |
|---|---|---|---|---|
| 4,972,487 | A | 11/1990 | Mangold et al. | |
| 5,303,306 | A * | 4/1994 | Brillhart et al. | 381/315 |
| 5,604,812 | A | 2/1997 | Meyer | |
| 5,636,285 | A * | 6/1997 | Sauer | 381/314 |
| 5,754,661 | A * | 5/1998 | Weinfurtner | 381/316 |
| 6,035,050 | A * | 3/2000 | Weinfurtner et al. | 381/313 |
| 6,044,163 | A | 3/2000 | Weinfurtner | |
| 6,674,867 | B2 * | 1/2004 | Basseas | 381/314 |
| 6,910,013 | B2 | 6/2005 | Allegro et al. | |
| 2002/0191799 | A1 | 12/2002 | Nordqvist et al. | |
| 2003/0144838 | A1 | 7/2003 | Allegro | |
| 2004/0047474 | A1 * | 3/2004 | Vries et al. | 381/60 |
| 2004/0190737 | A1 * | 9/2004 | Kuhnel et al. | 381/312 |
| 2005/0105750 | A1 | 5/2005 | Frohlich et al. | |
| 2006/0078139 | A1 * | 4/2006 | Meier et al. | 381/312 |

FOREIGN PATENT DOCUMENTS

| | | | |
|---|---|---|---|
| DE | 689 20 060 | T2 | 10/1989 |
| DE | 44 19 901 | A1 | 2/1996 |
| DE | 101 14 015 | A1 | 10/2002 |
| DE | 101 52 197 | A1 | 5/2003 |
| EP | 0 681 411 | A1 | 11/1995 |
| EP | 0 712 263 | A1 | 5/1996 |
| EP | 0 814 634 | A1 | 12/1997 |
| EP | 0 814 636 | A1 | 12/1997 |
| WO | WO 96/27711 | | 9/1996 |
| WO | WO 01/20965 | A3 | 3/2001 |

* cited by examiner

*Primary Examiner*—Vivian Chin
*Assistant Examiner*—Joseph Saunders, Jr.

(57) ABSTRACT

The training of a hearing aid for individual Situations is intended to be simpler and more comprehensive for the hearing aid wearer. The invention therefore provides for the hearing aid wearer just to have to associate a current acoustic Situation with a predetermined hearing Situation identification (3'). This association is learnt by a classifier, for example a neural network (5). After the training process, the neural network (5) can then reliably associate the corresponding hearing Situation identification (3') with an acoustic input Signal (2). A current Parameter Set (4') is varied or supplemented appropriately on the basis of this association.

6 Claims, 2 Drawing Sheets

METHOD FOR TRAINING AND OPERATING A HEARING AID

CROSS REFERENCE TO RELATED APPLICATIONS

This application claims priority to the German application No. 10347211.8, filed Oct. 10, 2003 and which is incorporated by reference herein in its entirety.

FIELD OF INVENTION

The present invention relates to a method for retraining a hearing aid by provision of an acoustic input signal, provision of two or more hearing situation identifications and association of the acoustic input signal with one of the hearing situation identifications by a hearing aid wearer. The present invention furthermore relates to a corresponding hearing aid which can be retrained, and to a method for operation of a hearing aid such as this after retraining.

BACKGROUND OF INVENTION

Classifiers are used in hearing aids in order to identify different situations. The preset parameters need not, however, necessarily be optimal for the corresponding situations for an individual hearing aid wearer. In specific situations, the identification rate with regard to the individual constraints can be improved by retraining, as is normally used for speaker-related speech recognition systems. This is of particular importance especially for the situation in which the wearer's own voice is being presented. The classifier may likewise be set optimally for specific noise Situations, which are typical of the acoustic environment of the hearing aid wearer.

SUMMARY OF INVENTION

In this context, the document EP 0 681 411 A1 discloses a programmable hearing aid, which automatically matches itself to changing environmental situations. The hearing aid parameters are in this case continuously matched to the existing environmental noise, in which case "fuzzy" inputs from the hearing aid wearer may be used in addition to the measured input signals. The objective in this case is to optimize the parameters directly, although the hearing situation is not described explicitly.

Furthermore, the document EP 0 814 634 A1 describes a method by means of which the hearing aid wearer sets the hearing aid optimally himself by carrying out a retraining process which he initiates himself. For selection purposes, the hearing aid wearer is provided with a range of predefined parameter sets for that hearing situation which he signals to the hearing aid. From this limited range of parameter sets, which each correspond to one hearing aid preset, he selects that which he finds to be the optimum. The corresponding hearing aid setting is learnt by a control mechanism, so that the same hearing aid setting is produced for a similar acoustic input Signal. This means that the control mechanism maps the acoustic input variables onto the Optimum hearing aid Parameter Set. During this retraining process, the hearing Situation is taken into account only indirectly, by making available for selection only those Parameter sets which correspond to this hearing Situation. However, direct matching of the hearing Situation to the acoustic input data is not carried out. This has the disadvantage that the hearing aid wearer has to assess the sound of the hearing aid, which is defined by the Parameter set being used, during such retraining. For example, he has to assess whether he wishes to be presented with the sound in a lighter or darker form. However, it is difficult, or even completely impossible, for the hearing aid wearer to distinguish between different Parameter sets for certain complex algorithms and dynamic adaptive Parameters, for example for controlling an adaptive directional microphone.

An object of the present invention is thus to simplify the retraining of a hearing aid for the hearing aid wearer, and to correspondingly improve the Operation of the hearing aid.

According to the invention, this object is achieved by the claims.

The invention is based on the discovery that, although it is difficult for the hearing aid wearer to distinguish between different Parameter Sets, the hearing aid wearer can in most cases very reliably name an acoustic Situation which currently exists, for example the Situation of "his own voice" or "being located in an automobile". These Situations go beyond the hearing Situations that are conventionally used in hearing aids, such as "Speech in a quiet environment" and "Speech in the presence of interference noise". This means that the hearing Situations between which a distinction is being drawn may relate to those aspect elements of these "classical" Situations which are relevant to Signal processing. The acoustic representations on which these novel, more comprehensive Situations are based, may be retrained individually in a simple manner by naming them specifically. For example, the sound of the hearing aid wearer's own voice or the specific sound of his own automobile may be learnt by the hearing aid, for example by means of a neural network. Thus, in contrast to the cited prior art according to EP 0 813 634 A1, the neural network does not map the acoustic input variables onto the resultant Overall Setting (Parameter Setting) of the hearing aid, but maps it onto the internal Situation representation (hearing Situation identification). The hearing aid Parameter Set to be used is then derived from this on the basis of audiological expert knowledge, with the relevant Parameters being varied and/or supplemented. In particular, the adaptive algorithms can use this information further without the hearing aid wearer having to assess the results. This simple association between the acoustic input Signal and predetermined hearing Situations is far less difficult for the hearing aid wearer than direct sound assessment such as assessment of the frequency response and/or compression relationships/knee Points, according to the prior art, owing to the adaptivity of the algorithms and the time dynamic response associated with them.

In one specific refinement according to the invention, one of the hearing Situations may correspond to the presentation of the hearing aid wearer's own voice, so that his own voice can be identified once it has automatically been learnt. This is of major importance in many Situations, for example for directional microphone adjustment.

The automatic learning of the at least one hearing aid Setting Parameter for the associated hearing Situation on the basis of the automatic evaluation may be carried out during (online) or after (offline) the presentation of the acoustic input Signal. During online retraining, the acoustic input Signal need not be stored completely, although the hearing aid requires more computation power in Order to carry out the retraining process. In the case of offline retraining, there is no need for this additional computation requirement in the hearing aid, although a Storage apparatus is required for the acoustic input Signal. Online evaluation avoids the time-consuming reading, processing and reprogramming of the data and/or of the hearing aid.

The input device for association of the acoustic input Signal with a hearing Situation may also be used for starting and stopping the retraining process. This simplifies the handling of the hearing aid and the process of carrying out the retraining for the hearing aid wearer.

Furthermore, the input device may comprise a receiver integrated in the hearing aid, or an external remote control. The remote control may be designed to communicate with the hearing aid with or without the use of wires. It is also feasible for the remote control to be used exclusively for retraining of the hearing aid. Alternatively, the remote control may be in the form of a multifunction device, for example a mobile telephone or a Portable Computer with a radio interface.

The input device may also comprise a programmable computation unit, in particular a PC, so that it is operated via appropriate programming Software.

Finally, in one specific embodiment, the input device may be operable verbally and, in particular, by means of one or more keywords. This makes the Operation of the hearing aid even more convenient for the hearing aid wearer.

Furthermore, the acoustic input Signal may comprise a Speech Signal which is preprocessed manually or automatically. This makes it possible to train the classifier very specifically.

During Operation of the hearing aid, that is to say after the retraining process, a currently applicable Parameter Set may be influenced by the automatic association between the current hearing Situation and hearing Situation identification. In particular, a Parameter in the Parameter Set may be varied and/or supplemented by the automatic association process. It is thus possible for the acoustic input Signal to be subjected to complex Signal processing on the basis of expert knowledge, when the neural network identifies a hearing Situation that it has learnt, for example a wearer's own voice. In this case, the Parameter Set which is currently used in the hearing aid may be appropriately modified, with appropriate filtering Operations being carried out.

BRIEF DESCRIPTION OF THE DRAWINGS

The present invention will now be explained in more detail with reference to the attached drawings, in which.

The exemplary embodiment which will be described in more detail in the following text represents one preferred embodiment of the present invention. However, in Order to assist understanding of the invention, the method for retraining on the basis of the prior art will first of all be explained in more detail once again, with reference to FIG. 1.

DETAILED DESCRIPTION OF INVENTION

Figure 1:
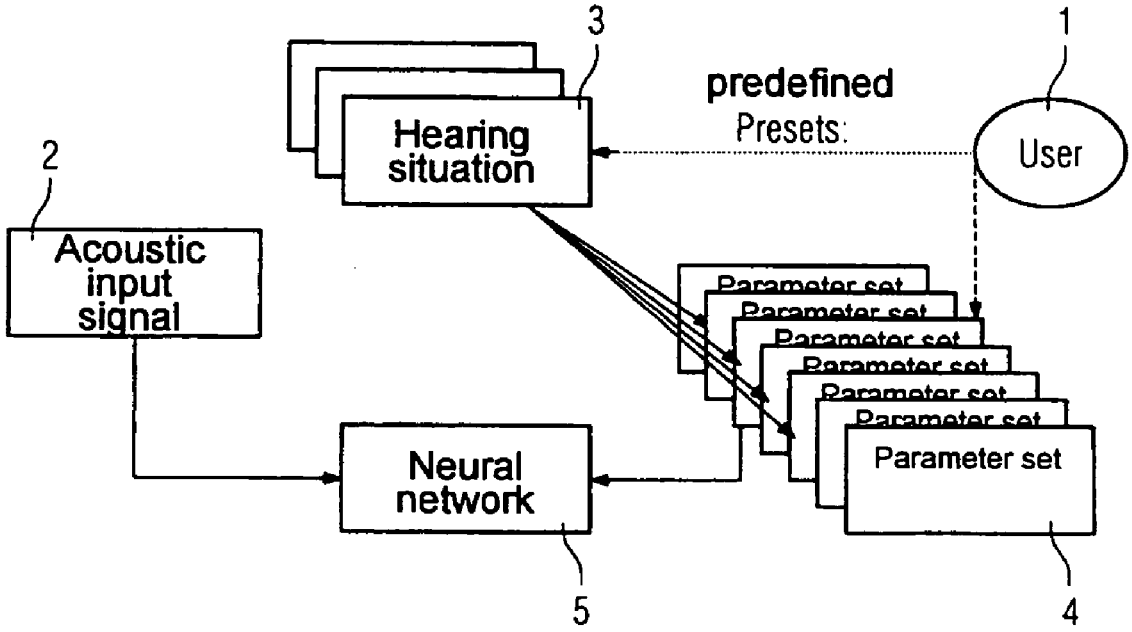
FIG 1 Prior Art
FIG. 1 Shows a block diagram relating to the method according to the prior art.

The hearing aid wearer or User 1 is in a specific acoustic Situation, as is illustrated in FIG. 1, in which the hearing aid is provided with an acoustic input Signal 2. Since the hearing aid is not subjectively Set optimally for the hearing aid wearer 1, he carries out a retraining process. To do this, he classifies the noise and Signals to the hearing aid the corresponding very general hearing Situation or hearing Situation identification, for example "Speech in the presence of interference noise". Each of these hearing Situations 3 is in each case associated with a large number of Parameter Sets 4. On the basis of the selected hearing Situation 3, the hearing aid wearer 1 has, for example, seven Parameter Sets for selection. He can now select that Parameter Set 4 which results in the hearing aid being Set such that it produces the subjectively best sound in this acoustic Situation.

A neural network 5 learns the desired Parameter Set 4 for the present acoustic input Signal 2, so that it will also once again select this Parameter Set 4 for a similar acoustic Situation after the training Phase. The subjective assessment of the Sounds, resulting from the different Parameter Sets for hearing aid Setting, is, however, very difficult for the hearing aid wearer 1, since this is dependent on large amounts of detailed knowledge about the effects of the hearing aid Parameters.

Thus, according to the present invention, the aim is for the hearing aid to be trained only by identification of the current Situation, rather than by using specific Parameter Sets. This is done in a corresponding manner to the method shown in FIG. 2. In this case as well, the hearing aid wearer or User 1 receives the acoustic input Signal 2. In Order to retrain the neural network 5 in the hearing aid, the hearing aid wearer 1 need only associate the acoustic Situation which currently exists with one of a large number of predetermined, specific hearing Situations 3'. The number of specific hearing Situations 3' in the case of the present invention is normally greater than the number of general hearing Situations 3 shown in FIG. 1, since the aim is to distinguish between them from the Start. This is because the general hearing Situation "Speech in the presence of interference noise", for example, includes the specific hearing Situation of the "wearer's own voice".

Figure 2:
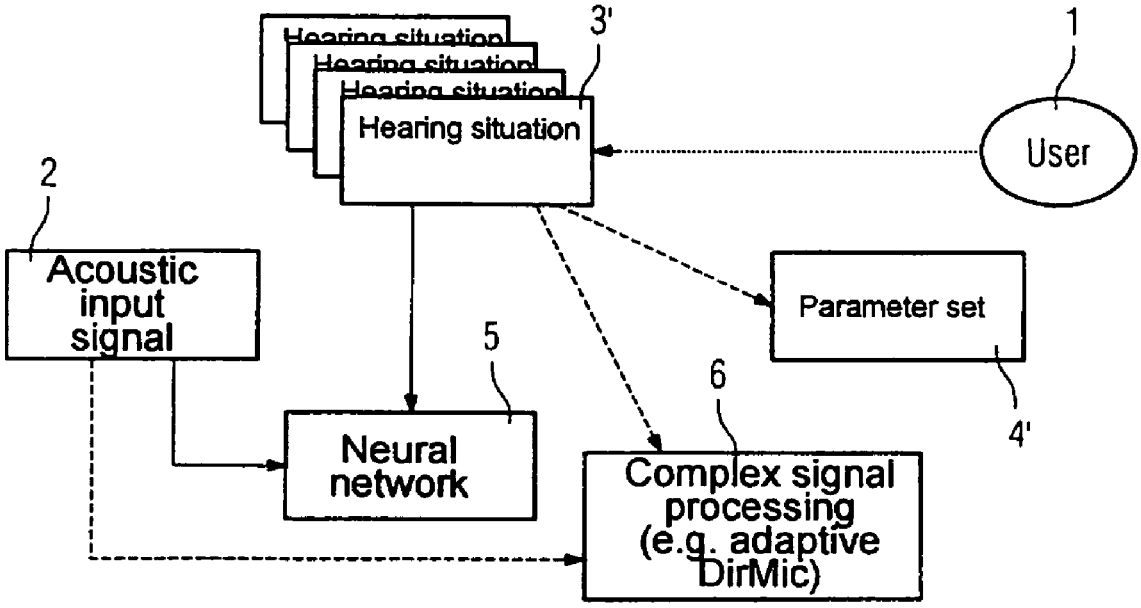
FIG. 2 Shows a block diagram for the method according to the invention.

The neural network 5 therefore does not learn the association between a Parameter Set and the acoustic input Signal 2, but the association between a defined hearing Situation or a hearing Situation identification 3' and the acoustic input Signal 2 (See the arrows with solid lines in FIG. 2). This means that, in contrast to the prior art, the neural network learns at a higher level. This will be explained in more detail using the example of the hearing Situation "the wearer's own voice in his own automobile". According to the prior art, this complex Situation is associated with a fixed Parameter Set on the basis, for example, of the Parameter Set group "Speech in the presence of interference noise". Since only a number of Parameter Sets are suitable for selection by the hearing aid wearer for such Situations of "Speech in the presence of interference noise", it is obvious that none of the available Parameter Sets are optimized for the wearer's own voice or, in addition, for his own automobile.

According to the invention, in contrast, the Situation of the "wearer's own voice" and the further Situation of "in his own automobile" are learnt separately. These hearing Situations each have a specific influence on the complex Signal processing. This results, for example, in the Situation of the "wearer's own voice" in a specific gain, possibly linked to a specific Setting of the directional effect of the hearing aid, and, in the Situation "in his own automobile" in interference noise Suppression that is once again highly specific in the hearing aid.

It is particularly advantageous that the hearing aid can learn the wearer's own voice. This is done by subjecting the acoustic input Signal with the wearer's own voice to specific processing, by specifically Setting appropriate Parameters for the hearing aid, and by associating this with the hearing Situation of the "wearer's own voice". A similar Situation applies to the learning, for example, of the hearing Situation of "his own automobile", thus resulting in the capability to achieve highly specific interference noise Suppression. Thus, during the learning process, not only is the input Signal associated with a hearing Situation, but Parameters such as filter or gain Parameters are also determined highly specifically.

During use of the hearing aid after the retraining process, the neural network 5 associates an acoustic input Signal 2 with one or more specific hearing Situation identifications 3', so that the currently applicable Parameter Set 4' (including filter Parameters) is influenced appropriately. A complex Signal processing unit 6, for example with an adaptive directional microphone, will carry out the Signal processing on the basis of the influenced Parameter Set 4'. If, on the basis of the above example, the neural network now receives the input Signal "the wearer's own voice in his own automobile", it associates this not only with the hearing Situation identification "the wearer's own voice" but also with the hearing Situation identification "in his own automobile", so that the current Parameter Set is varied or supplemented, for example in terms of the specific gain, for his own voice and with respect to the specific filtering for Suppression of the interference noise in his own automobile.

Two specific exemplary embodiments of the present invention will be described in the following text:

Example 1

An adaptive directional microphone is pointing in the direction from which the maximum useful sound, for example a Speech Signal, is arriving. If the hearing aid wearer is having a conversation with someone Walking alongside him, the directional microphone should be Set to the conversation Partner, that is to say to a maximum gain at an angle of about 90°. However, as soon as the hearing aid wearer speaks himself, the useful sound Signal Comes from his own mouth, that is to say from an angle of 0°. His own Speech thus draws the directional microphone characteristic away from the actual conversation Partner, to be precise normally with a certain time delay. If, in contrast, the hearing aid is trained to his own voice so that the adaptive microphone control which is associated with acoustic characteristics for his own voice is thus known, signals which are classified as "his own voice" can be ignored for the readjustment of the directional characteristic. This would be in contrast to the adjustment capability for the hearing aid according to the prior art from FIG. 1 in EP 0 814 634 A1, on the basis of which the hearing aid wearer would have to assess a number of Parameter Sets, with little prospect of success owing to the dynamic range and the adaptivity of the processes. In particular, his own voice could not be identified.

Example 2

An interference noise Suppression method can be specifically trained for complex noise which varies with time. This noise is then optimally suppressed, even though it may have similar spectral components or a modulation spectrum like Speech which should still be processed as a useful Signal. The interference noise Suppression method can be automatically optimally Set by individual training for this acoustic Situation, for example the Situation of "in his own automobile" as mentioned above, by, for example, Setting specific weighting factors for individual spectral bands, or by optimally matching the dynamic response to the interference noise characteristic. In this Situation as well, the differences between the settings for the dynamic interference noise Suppression can be directly assessed only with difficulty while, in contrast, the Situation can be assessed very reliably.

In certain acoustic Situations, it may be advantageous to carry out retraining on the basis of the prior art in addition to the retraining according to the invention, in Order to allow the hearing aid wearer to assess different Parameter Sets.

Figure 3:
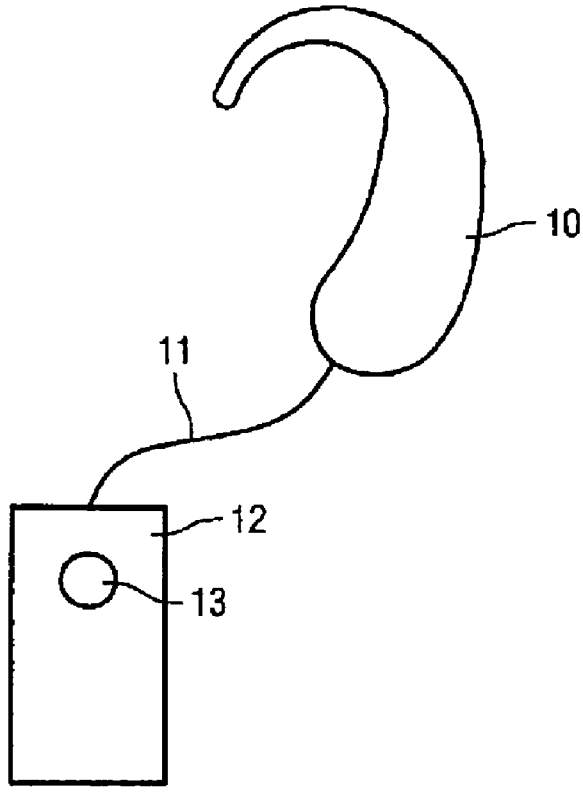
FIG. 3 Shows a basic illustration of a hearing aid with a remote control for inputting a hearing Situation in a first step.

The retraining process, as it appears to the hearing aid wearer, win now be explained in more detail with reference to FIGS. 3 and 4. The hearing aid wearer wishes, for example, to train his hearing aid 10 for the Situation of "the wearer's own voice". To do this, he connects a remote control 12 to the hearing aid 10 via a line 11. The remote control has a push button 13 as a control element.

A number of hearing Situations are stored in the classifier. The hearing aid wearer knows that the hearing Situation "his own voice" corresponds, for example, to the Situation 3. He thus presses the push button 13 three times in Order to Signal to the classifier that the aim is to retrain the Situation 3.

Figure 4:
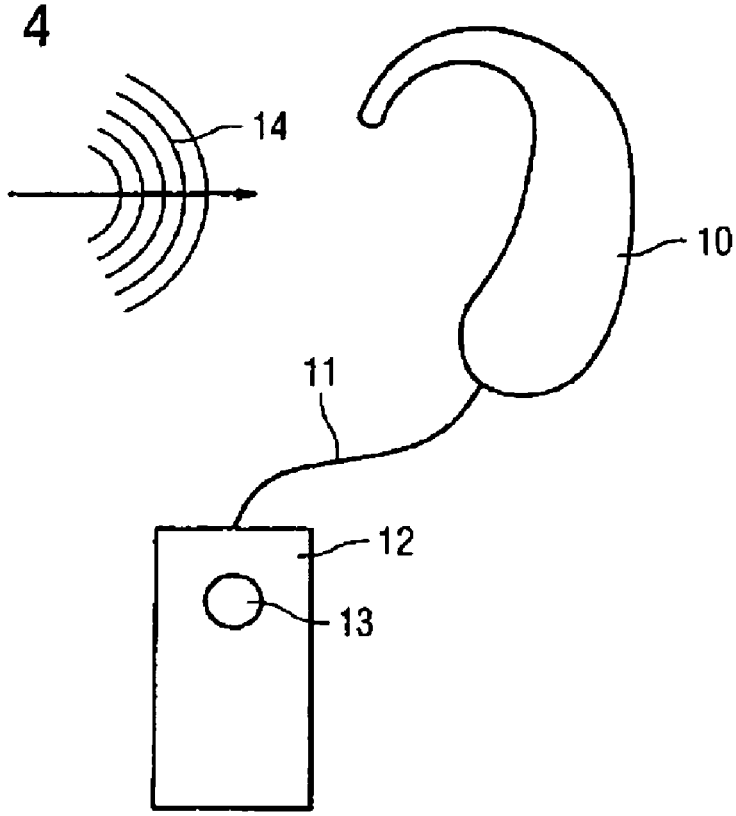
FIG. 4 Shows the Situation of the hearing aid shown in FIG. 3 during the training Phase.

In a subsequent step, an acoustic Signal (in this case the wearer's own voice) is presented to the hearing aid 10 for reception, as shown in FIG. 4. The hearing aid wearer now has to Signal to the hearing aid 10 the Start and the end of the training Phase. This is done by keeping the push button 13 pressed while he is himself speaking. This means that he need use only a Single control element 13 for both of the training steps. If there are a very large number of hearing Situation identifications, a different design may be more convenient for use, for example with a display and a regulator (shift regulator, trackball, etc.), by means of which the corresponding Situation can be selected quickly.

The actual retraining of the hearing aid 10 can be carried out while the acoustic Signal 14 is being presented. Alternatively, the acoustic Signal 14 is recorded in the hearing aid and is evaluated after being recorded, and is associated with the selected hearing Situation on the basis of characteristic acoustic properties. In the case of online retraining, the acoustic Signal 14 need not necessarily be permanently or temporarily stored.

Since the hearing aid 10 need be signaled only with the information about the current Situation, it is not absolutely necessary to have an external control unit, in contrast to the prior art according to EP 0 814 634 A1. However, this may be used for convenience reasons, for example as shown in FIGS. 3 and 4. However, a receive knob may also be fitted to the hearing aid itself.

After the retraining process, the identification rate of the classifier can be increased considerably for specific Situations over the preset level, so that the hearing aid is Set more reliably in this Situation. The automatic starting and ending of the retraining phase by the hearing aid wearer also makes it possible to carry out reliable retraining for certain Situations, since the hearing aid wearer himself decides when the Signal can be associated with the Situation.

The invention claimed is:

1. A method for operating a hearing aid, comprising:

receiving an acoustic input signal by the hearing aid;

receiving an assignment of the acoustic input signal from a user of the hearing aid, wherein the assignment comprises an assignment of the acoustic input signal with one of a plurality of predetermined specific hearing situation identifications identifying situations where the hearing aid is used by a user of the hearing aid;

automatically adjusting a setting of the hearing aid as a function of the assigned one of a plurality of predetermined hearing situation identifications by the user of the hearing aid, wherein the setting is derived by the hearing aid learning two or more situations where the hearing aid is used separately such that the setting is suitable for use when the two or more hearing situations occur at the same time; and utilizing the setting derived from two or more hearing situations when the two or more hearing situations occur at the same time.

2. The method according to claim 1, wherein the setting includes a current applicable parameter set.

3. The method according to claim 2, wherein the current applicable parameter set is modified by the received assignment.

4. The method according to claim 3, wherein at least one parameter of the current applicable parameter set is varied.

5. The method according to claim 3, wherein a parameter is added to the current applicable parameter set.

6. The method according to claim 1, wherein the two or more hearing situations comprise a sound of the hearing aid user's voice and a sound of the hearing aid user's automobile such that the hearing aid is adapted to recognize the sound of the user's voice and automobile together after the learning.

* * * * *